US009957841B2

(12) United States Patent
Gendraud et al.

(10) Patent No.: US 9,957,841 B2
(45) Date of Patent: May 1, 2018

(54) TURBINE STAGE FOR A TURBINE ENGINE

(71) Applicant: SNECMA, Paris (FR)

(72) Inventors: Alain Dominique Gendraud, Vernou la Celle sur Seine (FR); Alberto Martin-Matos, Thomery (FR); Vincent Millier, Tigery (FR); Sebastien Jean Laurent Prestel, Coubert (FR)

(73) Assignee: SNECMA, Paris (FR)

( * ) Notice: Subject to any disclaimer, the term of this patent is extended or adjusted under 35 U.S.C. 154(b) by 590 days.

(21) Appl. No.: 14/394,355

(22) PCT Filed: Apr. 17, 2013

(86) PCT No.: PCT/FR2013/050843
§ 371 (c)(1),
(2) Date: Oct. 14, 2014

(87) PCT Pub. No.: WO2013/156734
PCT Pub. Date: Oct. 24, 2013

(65) Prior Publication Data

US 2015/0118035 A1 Apr. 30, 2015

(30) Foreign Application Priority Data

Apr. 20, 2012 (FR) ..... 12 53644

(51) Int. Cl.
*F01D 25/24* (2006.01)
*F01D 9/04* (2006.01)
*F01D 11/00* (2006.01)

(52) U.S. Cl.
CPC ..... *F01D 25/246* (2013.01); *F01D 9/04* (2013.01); *F01D 9/041* (2013.01); *F01D 9/042* (2013.01);
(Continued)

(58) Field of Classification Search
CPC . F01D 25/246; F05D 2240/11; F05D 2260/30
(Continued)

(56) References Cited

U.S. PATENT DOCUMENTS 5,188,507 A 2/1993 Sweeney
5,669,757 A 9/1997 Brackett
(Continued)

FOREIGN PATENT DOCUMENTS

EP 1 462 616 A2 9/2004
JP 6-94801 B2 11/1994
JP 2005-30314 A 2/2005

OTHER PUBLICATIONS

English translation of JP 2005030314.*
International Search Report dated Jul. 30, 2013 in PCT/FR2013/050843 filed Apr. 17, 2013.

*Primary Examiner* — Woody Lee, Jr.
*Assistant Examiner* — Brian O Peters
(74) *Attorney, Agent, or Firm* — Oblon, McClelland, Maier & Neustadt, L.L.P.

(57) ABSTRACT

A turbine stage for a turbine engine, the stage including a nozzle and a wheel mounted inside a sectorized ring carried by a casing. The nozzle is attached to the casing and is retained axially downstream by bearing against an annular split ring. Each ring sector includes at its upstream end a member of C-shaped section that is engaged on the casing rail and that holds the split ring radially. A radially inner wall of the C-shaped member of each ring sector extends inside the split ring over an entire axial dimension thereof and its upstream end portion is engaged in at least one recess of the nozzle.

8 Claims, 5 Drawing Sheets

(52) U.S. Cl.
CPC ..... *F01D 11/005* (2013.01); *F05D 2230/60* (2013.01); *F05D 2240/10* (2013.01); *F05D 2240/128* (2013.01); *F05D 2240/91* (2013.01)

(58) Field of Classification Search
USPC ..... 415/209.2
See application file for complete search history.

(56) References Cited

U.S. PATENT DOCUMENTS

| | | | | |
|---|---|---|---|---|
| 5,848,854 | A | 12/1998 | Brackett | |
| 6,062,813 | A | 5/2000 | Halliwell et al. | |
| 8,734,100 | B2 | 5/2014 | Garin et al. | |
| 2005/0004810 | A1 | 1/2005 | Tanaka | |
| 2007/0094880 | A1 | 5/2007 | Sherlock et al. | |
| 2010/0284811 | A1* | 11/2010 | Druez ..... | F01D 9/042 416/179 |

* cited by examiner

TURBINE STAGE FOR A TURBINE ENGINE

BACKGROUND OF THE INVENTION

Field of the Invention

The invention relates to a turbine stage for a turbine engine, such as an airplane turboprop or turbojet.

Description of the Related Art

Typically, a turbine stage of this type comprises a stationary nozzle and a turbine wheel mounted downstream from the nozzle and inside an annular casing. The nozzle has two coaxial platforms lying one inside the other and connected together by substantially radial vanes. The outer platform has two annular tabs, respectively an upstream tab and a downstream tab, which tabs extend radially outwards and include at their outer peripheries attachment means for attachment to the casing. The nozzle is held radially by hooks of the casing. The downstream annular tab of the nozzle bears radially outwards against a cylindrical rail of the casing and bears axially downstream against an annular split ring received in an annular groove of the rail, the groove being open in a radially inward direction.

The wheel is formed by a rotor disk carrying blades at its periphery. It is rotatably mounted inside a sectorized ring carried by the casing. Each ring sector has a circumferential member of C-shaped section at its upstream end, which member is engaged on the casing rail and serves to hold the split ring radially in the above-mentioned groove of the rail.

The C-shaped member is engaged on the casing rail by being moved axially from downstream, followed by moving the ring sector in tilting. To do this, the ring sector is initially arranged so that its upstream end is situated radially further out than its downstream end. The ring sector is moved upstream with the C-shaped member being engaged on the casing rail over a given axial distance, and then the downstream end of the ring sector is tilted radially outwards in order to finish off engaging the member on the rail.

In the prior art, the upstream circumferential edge of the radially inner wall of the C-shaped member of each ring sector is spaced apart from the downstream annular tab of the nozzle by axial clearance, this clearance being necessary to make it possible to perform the above-mentioned assembly operation by titling the ring sector. Because of this axial clearance, the radially inner wall of the C-shaped member extends radially inside a small portion of the axial dimension of the split ring, which portion is in principle sufficient to hold the split ring radially in the groove. In a particular embodiment, the above-mentioned clearance is about 1.9 millimeters (mm)±0.25 mm.

Nevertheless, because of manufacturing tolerances and because of differential thermal expansions of the parts in operation, the upstream end portion of the radially inner wall of the C-shaped member that retains the split ring may present an axial dimension that is insufficient, or even zero under the most unfavorable conditions. It is then possible for the split ring to become disengaged, which would lead to the nozzle no longer being prevented from moving axially downstream, and that is not acceptable.

BRIEF SUMMARY OF THE INVENTION

An object of the invention is to provide a solution to this problem of the prior art, which is simple, effective, and inexpensive.

To this end, the invention provides a turbine stage for a turbine engine, the stage comprising a stationary nozzle and a wheel mounted downstream from the nozzle and inside an annular casing, the nozzle being attached to the casing and being retained axially downstream by bearing against an annular split ring mounted in an annular groove of a rail of the casing, the wheel being mounted inside a sectorized ring carried by the casing, each ring sector including at its upstream end a member of C-shaped section that is engaged on the casing rail and that holds the split ring radially in the above-mentioned groove, the stage being characterized in that the radially inner wall of the C-shaped member of each ring sector extends inside the split ring over the entire axial dimension thereof and its upstream end portion is engaged in at least one recess of the nozzle, the upstream circumferential edge of the radially inner wall of the C-shaped member of each ring sector including at least one notch co-operating with complementary means of the nozzle in order to prevent a ring sector from moving in rotation relative to the nozzle.

According to the invention, the C-shaped member is configured so that its radially inner wall extends axially over the entire axial dimension of the split ring and thus serves to retain the split ring radially regardless of manufacturing tolerances and regardless of differential expansions of the parts. In order to allow the C-shaped member to be assembled as described above, in particular by being tilted, the nozzle includes a recess for receiving the upstream end portion of the radially inner wall of the member.

The upstream end portion of the radially inner wall of the C-shaped member of each ring sector may be spaced apart from the bottom or from a radial wall of the above-mentioned recess of the nozzle by axial clearance in order to make such assembly possible. This axial clearance may be of the same general size as that described above, i.e. of the order of about 2 mm.

The upstream end portion of the radially inner wall of each C-shaped member may also be spaced apart from an outer cylindrical wall of the recess by radial clearance that is small or zero, this wall extending around the end portion that forms the radial retaining means of the nozzle. The casing hook of the prior art, which is dedicated to performing this radial retention, can therefore be omitted, thus enabling the nozzle to be simplified and enabling the weight of the casing to be reduced by about 3 kilograms (kg) in a particular embodiment of the invention.

Using the nozzle to prevent the ring from moving in rotation avoids any need to install a specific peg for preventing the ring from turning relative to the casing, which peg would require the thickness and the diameter of the casing to be increased in order to provide secure mechanical retention for the peg, which would increase the weight of the casing.

The way movement in rotation is prevented by the invention thus serves to reduce the radial size of the turbine stage.

In another aspect of the invention, the complementary means of the nozzle include local extra thickness of the nozzle.

According to another characteristic of the invention, the radially inner wall of the C-shaped member of each ring sector has an axial dimension that is greater than that of the radially outer wall of that member.

The nozzle may include a radially outer annular tab at its downstream end, the tab having an outer cylindrical surface for bearing radially against the casing rail and a downstream radial surface for bearing against the split ring, the above-mentioned recess(es) opening out downstream at least in part in this downstream radial surface.

The nozzle may be sectorized, being made up of a plurality of sectors arranged circumferentially end to end. The above-mentioned recesses may be circumferentially oriented, their circumferential ends opening out in the circumferential ends of nozzle sectors, or being closed by side webs of the nozzle sectors.

The facing lateral edges of the annular tab sectors of the nozzle sectors preferably include rectilinear slots for receiving sealing strips that extend radially outwards to the proximity of the casing rail and/or of the split ring, the grooves extending in a plane situated upstream from the above-mentioned recesses, or extending at least in part in the above-mentioned side webs of the nozzle sectors. These strips serve to limit gas leakage between sectors.

Finally, the invention provides a turbine engine, such as an airplane turboprop or turbojet, characterized in that it includes at least one turbine stage as described above.

BRIEF DESCRIPTION OF THE SEVERAL VIEWS OF THE DRAWINGS

The invention can be better understood and other details, advantages, and characteristics of the invention appear more clearly on reading the following description made by way of non-limiting example and with reference to the accompanying drawings, in which.

DETAILED DESCRIPTION OF THE INVENTION

Figure 1:
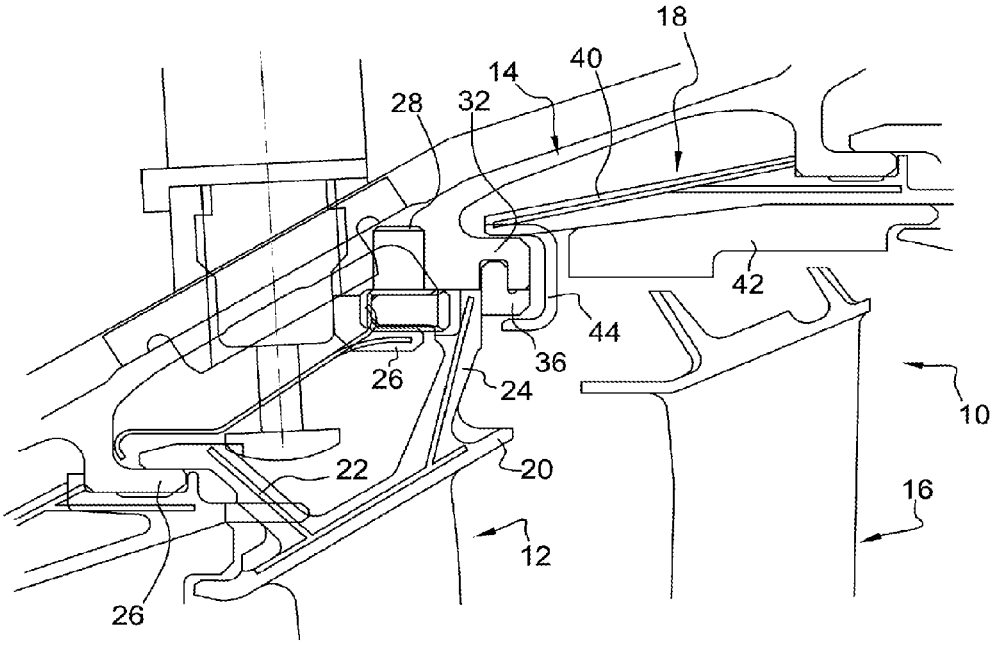
Fig. 1 Prior Art
FIG. 1 is a fragmentary diagrammatic half-view in axial section of a turbine stage of a turbine engine in the prior art.

Reference is made initially to FIG. 1, which shows a low pressure turbine 10 of a turbine engine such as an airplane turboprop or turbojet, the turbine having a plurality of stages, each including a nozzle 12 attached to a casing 14 of the turbine, and a bladed wheel 16 mounted downstream from the nozzle 12 and rotating in a ring 18 attached to the casing 14.

The nozzle 12 comprises two coaxial platforms, respectively an inner platform and an outer platform 20 that are connected together by vanes that are substantially radial. The outer platform 20 has two annular tabs, respectively an upstream tab 22 and a downstream tab 24, which tabs extend radially outwards and include attachment means for attaching to the casing.

The tabs 22, 24 of the nozzle 12 include upstream cylindrical rims at their outer peripheries for attachment to cylindrical rails 26 of the casing. The cylindrical rim of the downstream tab 24 includes at least one radial notch having engaged therein a radial peg 28 that is carried by the casing 14 for the purpose of preventing the nozzle from moving in rotation relative to the casing.

Figure 2:
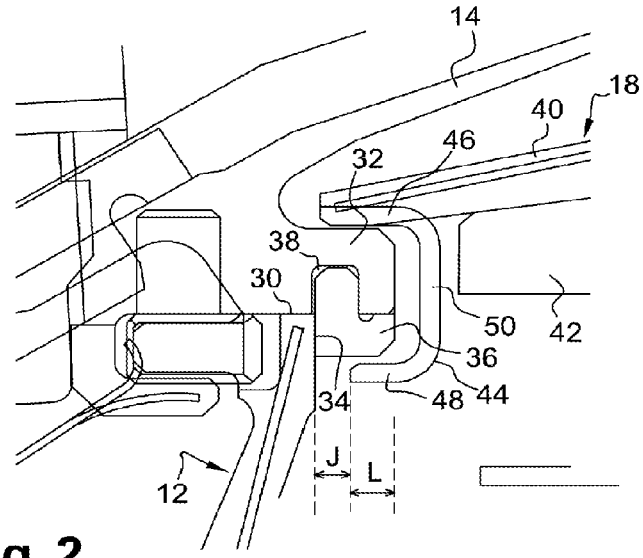
Fig. 2 Prior Art
FIG. 2 is a view on a larger scale of a portion of FIG. 1.

The downstream tab 24 of the nozzle 12 has a radially outer cylindrical surface 30 bearing radially against another rail 32 of the casing, and a downstream radial surface 34 bearing axially against an annular split ring 36 received in an annular groove 38 of the rail, the groove 38 opening out radially inwards (FIG. 2). This split ring 36 serves to retain the nozzle 12 axially downstream.

The ring 18 around the wheel is sectorized, being made up of a plurality of sectors that are carried circumferentially end to end by the casing 14 of the turbine.

Each ring sector 18 comprises a cylindrical or frustoconical wall 40 and a block 42 of abradable material that is fastened to the radially inner surface of the wall 40 by brazing and/or welding, the block 42 being of the honeycomb type and being for the purpose of being worn away by friction against outer annular wipers of the blades of the wheel 16 in order to minimize radial clearance between the wheel and the ring sectors 18.

Each ring sector 18 has a circumferential member 44 of C-shaped section at its upstream end, the opening in the member opening out upstream and the member being engaged axially from downstream on the casing rail 32 and the split ring 36 (FIG. 2).

The member 44 of each ring sector 18 has two cylindrical walls 46 and 48 extending upstream, respectively a radially outer wall and a radially inner wall, which walls are connected together at their downstream ends by a radial wall 50. The wall 46 of the member is pressed radially against a radially outer cylindrical face of the rail 32 and its inner wall 48 extends radially inside a portion of the split ring 36, as shown in FIG. 2.

In the prior art, the inner wall 48 of each member 44 has an axial dimension that is smaller than that of its outer wall 46, and the upstream circumferential edge of this inner wall is separated from the bearing surface 34 of the nozzle 12 by axial clearance J that is sufficiently large to allow the ring sectors 18 to be mounted by being tilted, as described above. As a result, the upstream end portion of the inner wall 48 of each member 44 extends over only a small distance L over the axial dimension of the split ring 36, and that might not be sufficient to retain the split ring in the groove 38, in particular under the most unfavorable conditions in which the distance L is reduced as a result of tolerances relating to manufacturing the parts and of differential thermal expansions of the parts in operation.

The invention enables this problem to be remedied by lengthening the inner wall of the C-shaped member of each ring sector, the upstream end portion of the inner wall being received in a corresponding recess of the nozzle so as to allow the ring sectors to be mounted.

Reference is made initially to FIGS. 3 to 7 which show a first embodiment of the invention.

Figure 3:
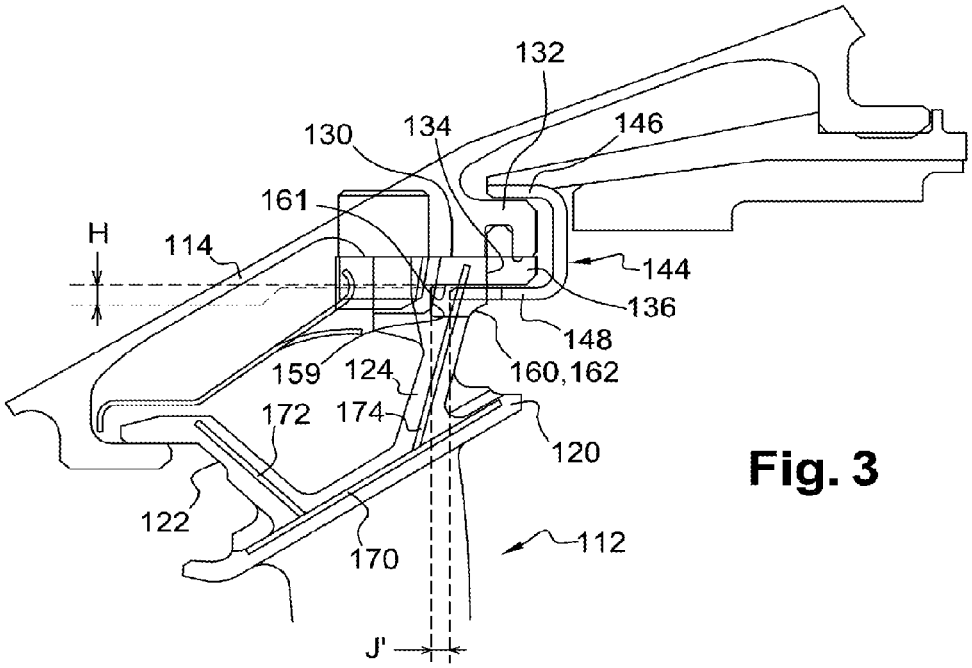
FIG. 3 is a fragmentary diagrammatic half-view in axial section of a turbine stage of a turbine engine of the invention.
Figure 4:
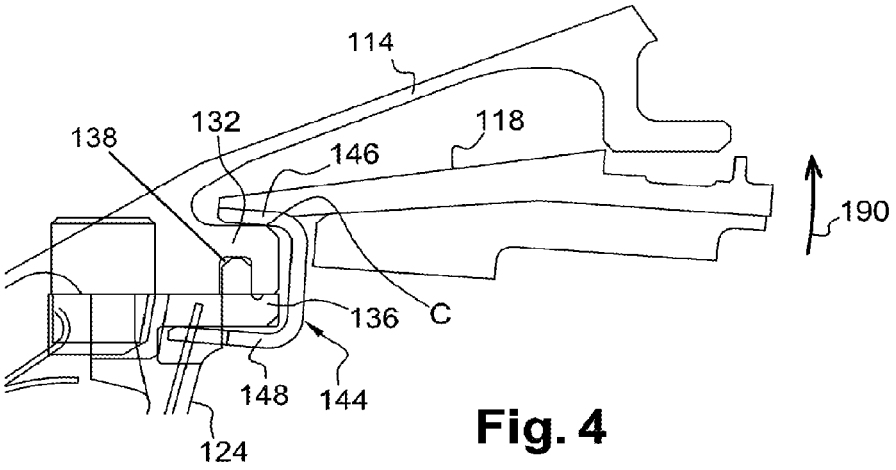
FIG. 4 is a view on a larger scale of a portion of FIG. 3 and shows a step of mounting a ring sector by tilting.
Figure 5:
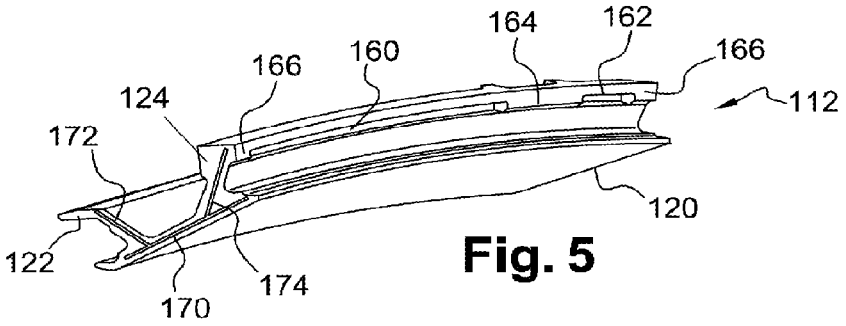
FIG. 5 is a diagrammatic view in perspective of an outer platform of a nozzle sector of the invention.

The nozzle 112 shown in FIGS. 3 to 7 differs from that described above in particular in that its downstream annular tab 124 includes recesses of the above-specified type that, in the example shown, are formed by circumferential grooves 160, 162 in the outer periphery of the tab 124, the grooves opening out axially downstream (FIGS. 3, 4, and 5). The radially outer portions of these grooves 160, 162 open out in the radial surface 134 of the downstream tab 124 that is to press against the split ring 136 carried by the annular groove 138 of the rail 132 of the casing 114.

The nozzle 112 is sectorized and comprises a plurality of nozzle sectors arranged circumferentially end to end. FIG. 5 shows only a portion of a nozzle sector (only the outer platform 120 and its annular tabs 122, 124 are shown).

Each nozzle sector 112 has an annular groove 160 extending over more than half of the circumferential dimension of the sector, and an annular groove 162 of smaller size. These grooves 160, 162 are situated on the same circumference and they are separated from each other by an axial extra thickness 164 of the downstream tab 124.

Each groove 160, 162 has one circumferential end closed by the above-mentioned extra thickness 164, and the other circumferential end of each groove is closed by a web 166 of material of the downstream tab 124, this web extending axially downstream.

As can be seen in FIGS. 3 and 5, the facing side edges of the nozzle sectors 112 include rectilinear slots for receiving sealing strips (not shown). Each side edge includes a rectilinear slot 170 extending along the longitudinal edge of the outer platform 124, a rectilinear slot 172 extending radially along the side edge of an upstream tab sector 122, and a rectilinear slot 174 extending radially along the side edge of a downstream tab sector 124. Each slot 174 is formed in part in the above-mentioned web 166 and extends to the immediate vicinity of the outer cylindrical surface 130 of the downstream tab.

The ring sectors 118 shown in FIGS. 3 to 7 differ from those described above in particular in that the radially inner walls 148 of their C-shaped members 144 have an axial dimension that is greater than that of their radially outer walls 146. As can be seen in FIG. 3, the radially inner wall 148 of the member 144 of each ring sector 118 extends over the entire axial dimension of the split ring 136 and beyond the splint ring in an upstream direction as far as into the above-mentioned groove 160, 162 of the nozzle.

Figure 6:
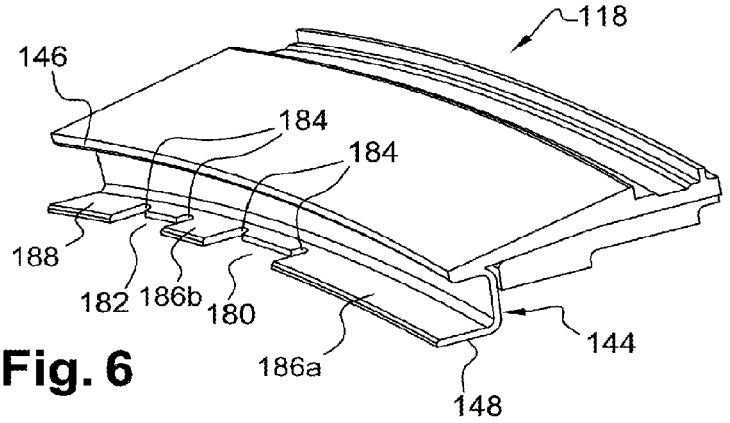
FIG. 6 is a diagrammatic view in perspective of a ring sector of the invention.

FIG. 6 shows a ring sector 118. The inner wall 148 of the member 144 has two radial notches 180, 182 in the example shown, these notches being for co-operating with complementary means of the nozzle to prevent the sector from moving relative to the nozzle, as described in greater detail below.

The notches 180, 182 are substantially U-shaped and they are defined by two parallel side edges connected together at their downstream ends by a circumferential edge. In the example shown, each side edge of a notch is connected to the circumferential edge of that notch by an orifice 184 of circular section for the purpose of reducing stress concentrations in this zone in operation.

The notch 180 in the inner wall 148 of the member 144 of each ring sector 118 is situated substantially in the middle of the wall and is for receiving the local extra thickness 164 of the downstream tab 124 of the nozzle.

Figure 7:
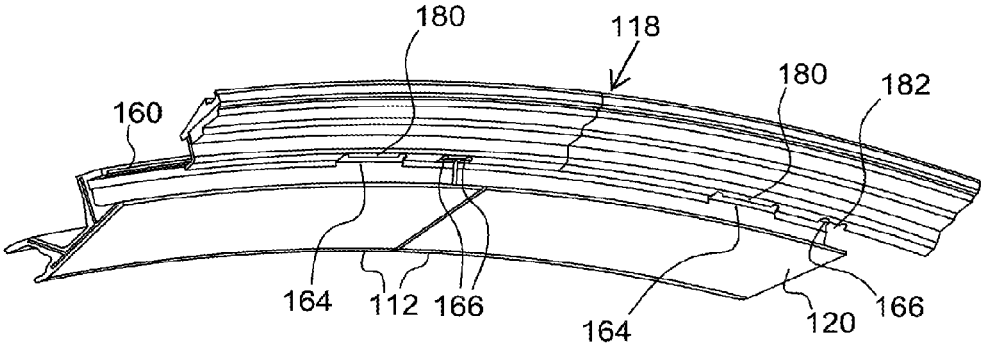
FIG. 7 is a diagrammatic view in perspective of outer platforms and of ring sectors of the types shown in FIGS. 5 and 6, in the assembled position.
Figure 8:
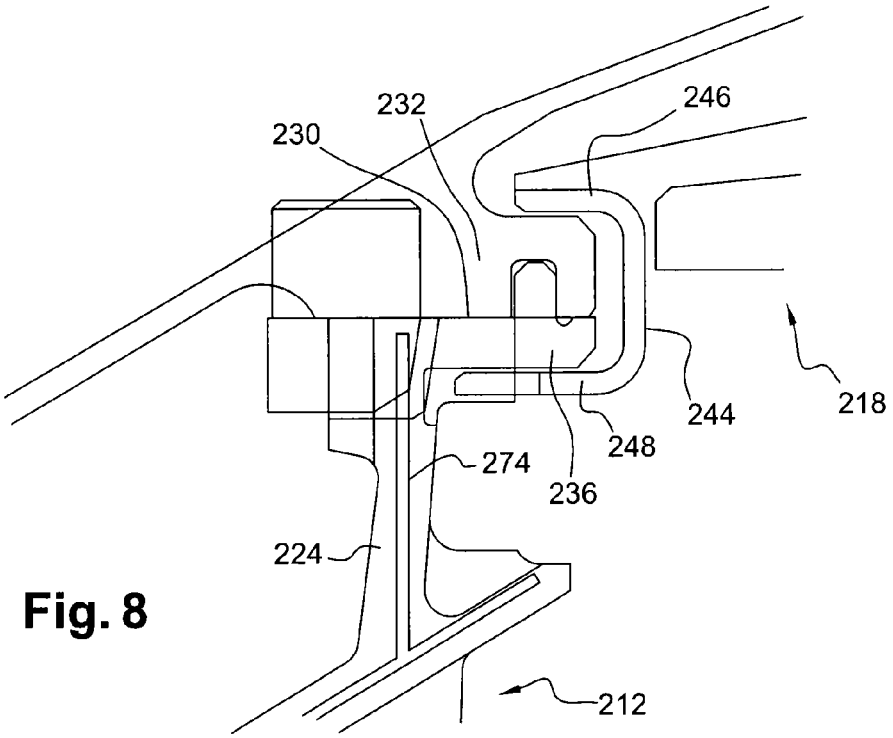
FIG. 8 is a view corresponding to FIG. 3 and showing a variant embodiment of the turbine stage of the invention.
Figure 9:
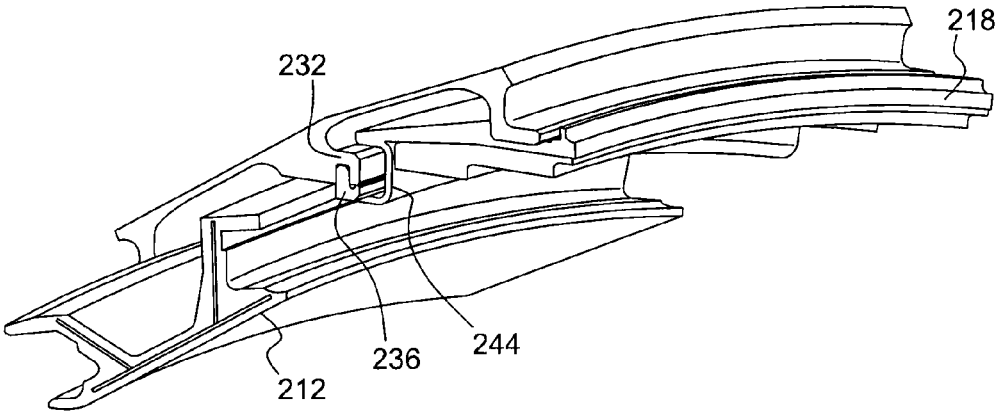
FIG. 9 is a fragmentary diagrammatic view in perspective of the FIG. 8 stage.
Figure 10:
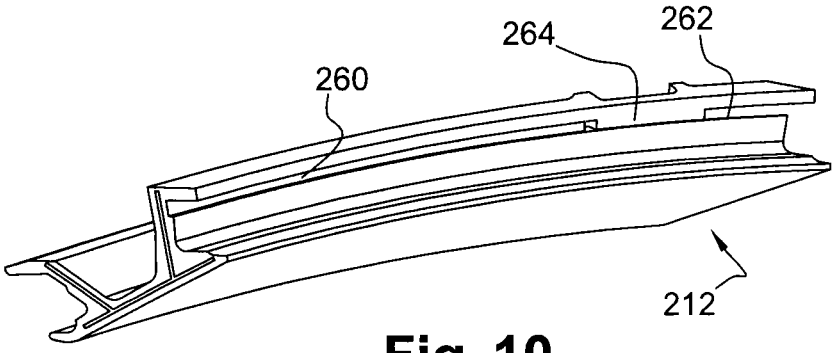
FIG. 10 is a diagrammatic view in perspective of an outer platform of a nozzle sector of the invention.

As can be seen in FIG. 7, the ring sectors 118 are offset in a circumferential direction relative to the nozzle sectors 112, such that the longitudinal edges of the platforms 120 of the nozzle sectors are not axially in alignment with the longitudinal edges of the ring sectors 118. This serves in particular to make the assembly more leaktight.

The notch 182 in the inner wall 148 of the member 144 of each ring sector 118 is for receiving the facing webs 166 of material of two adjacent nozzle sectors 112, as can be seen in FIG. 7.

As is clearly visible in FIG. 6, the notches 180, 182 define between them three distinct upstream end portions 186*a*, 186*b*, and 188 of the inner wall 148 of the member, one of them 186*a* being engaged in a portion of the groove 160 of a nozzle sector 112, another one of them 186*b* being engaged in the groove 162 of the sector, and the last one of them 188 being engaged in a portion of the groove 160 of an adjacent nozzle sector (FIG. 7).

FIG. 4 shows a step of assembling a ring sector 118 on the casing 114. The ring sector 118 is arranged obliquely so that its upstream end is situated radially further out than its downstream end. The ring sector is moved from downstream towards the casing rail 132 until the rail engages between the walls 146 and 148 of the C-shaped member 144 of the sector. The inner wall 148 of the member then engages in the above-mentioned grooves 160, 162 of the downstream tab 124 of the nozzle 112, as shown in FIG. 4. Thereafter, the downstream end of the ring sector 118 is tilted radially outwards in order to press the downstream end against a rail of the casing (arrow 190). Titling is performed by causing the ring sector 118 to turn about a point located substantially at C.

In the assembled position as shown in FIG. 3, the upstream circumferential edge of the inner wall 148 of the member 144 of each ring sector 118 is spaced apart from the bottoms or radial walls 159 of the grooves 160, 162 by axial clearance J' that is sufficient to allow such assembly to be performed by tilting. During the tilting, this clearance J' decreases, as can be seen in FIG. 4. Furthermore, the upstream end portions of the inner wall 148 of each member 144 extend inwards and parallel to an outer cylindrical wall 161 of each groove 160, 162, and they are spaced apart from this wall 161 by radial clearance H that is small or even zero. These end portions thus form means for radially retaining the downstream ends of the nozzle sectors.

Reference is made below to FIGS. 8 to 12 which show a variant embodiment of the invention in which the nozzle sectors 212 differ from the above-described sectors 112 essentially in that each of the grooves 260, 262 for receiving the inner walls 246 of the C-shaped members 244 of the ring sectors 218 has one of its circumferential ends that is not closed and that is therefore open in the circumferential direction at one of the side edges of a nozzle sector.

The groove 260 of greater circumferential size of a nozzle sector 212 has one circumferential end closed by the above-mentioned local extra thickness 264 and another circumferential end that opens out to one of the side edges of the sector. The groove 262 of smaller circumferential size of a nozzle sector 212 has one circumferential end closed by the above-mentioned local extra thickness 264 and another circumferential end that opens out to the other side edge of the sector.

The rectilinear slots 274 formed in the side edges of the downstream tab sectors 224 of the nozzle sectors 212 in this embodiment extend substantially radially in a plane situated upstream from the grooves 260, 262. The radially outer ends of these slots 274 are situated in the immediate vicinity of the outer cylindrical surface 230 of the tab 224.

The ring sectors 218 differ from the above-described sectors 118 essentially in that each of the radially inner walls 248 of their C-shaped members has only one notch 280 that is similar to the above-described notch 180, this notch 180 being for receiving the above-mentioned extra thickness 264 of a nozzle sector.

Figure 11:
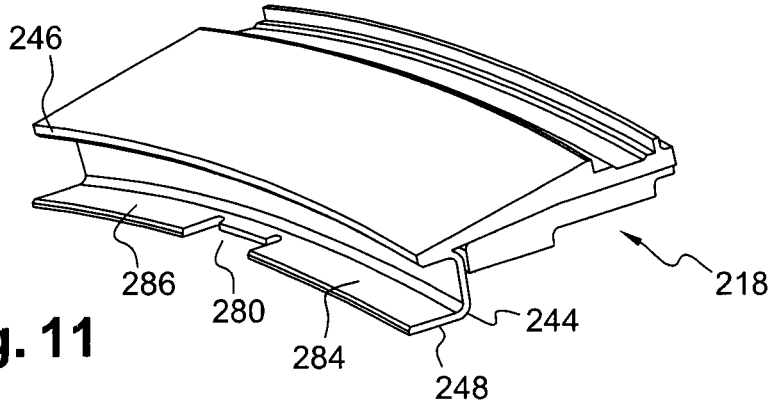
FIG. 11 is a diagrammatic view in perspective of a ring sector of the invention.
Figure 12:
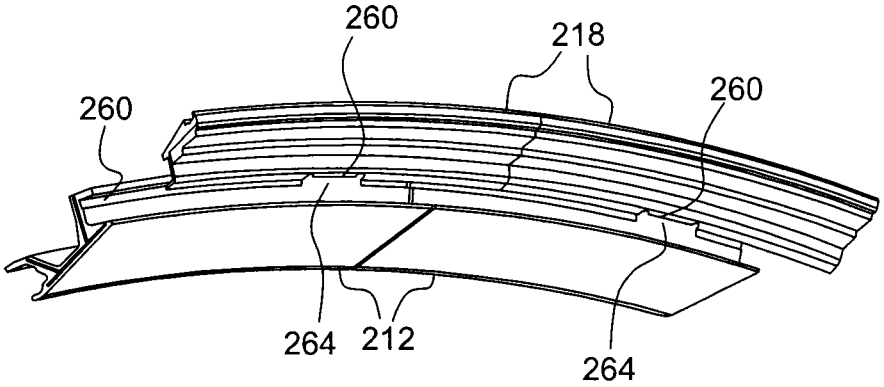
FIG. 12 is a diagrammatic view in perspective of outer platforms and of ring sectors of the types shown in FIGS. 10 and 11, in the assembled position.

As can be seen in FIG. 11, the notch 280 defines two distinct upstream end portions 284, 286 of the inner wall 248 of the member, one of them 284 being engaged in a portion of the groove 260 of a nozzle sector 212 and the other one of them 286 being engaged in the groove 262 of that sector and in a portion of the groove 260 of an adjacent nozzle sector (FIG. 12).

The ring sectors 218 are assembled in the same manner as that described above with reference to FIG. 4.

The invention claimed is:

1. A turbine stage for a turbine engine, the stage comprising:

a stationary nozzle and a wheel mounted downstream from the nozzle and inside an annular casing, the nozzle being attached to the casing and being retained axially downstream by bearing against an annular split ring mounted in an annular groove of a rail of the casing, the wheel being mounted inside a sectorized ring carried by the casing, the sectorized ring including a plurality of ring sectors, each ring sector including, at an upstream end thereof, a C-shaped member that is engaged on the casing rail and that holds the split ring radially in the groove, a radially inner wall of the C-shaped member of each ring sector extends inside the split ring over an entire axial dimension thereof, and an upstream end portion of the radially inner wall of the C-shaped member of each ring sector is engaged inside and enclosed by a first recess and a second recess of the nozzle, an upstream circumferential edge of the radially inner wall of the C-shaped member of each ring sector including at least one notch co-operating with complementary means of the nozzle to prevent each ring sector from moving in rotation relative to the nozzle, wherein the nozzle includes a radially outer annular tab at a downstream end thereof, the tab including an outer cylindrical surface for bearing radially against the casing rail and a downstream radial surface for bearing against the split ring, the first recess and the second recess being formed in the tab and opening out downstream in the downstream radial surface, and wherein the first recess and the second recess are separated from each other by an axial extra thickness of the tab, a first circumferential end of the first recess and a first circumferential end of the second recess being closed by the axial extra thickness of the tab, a second circumferential end of the first recess being closed by a first web of material of the tab extending axially downstream, a second circumferential end of the second recess being closed by a second web of material of the tab extending axially downstream, and the first recess being circumferentially longer than the second recess.

2. The stage according to claim 1, wherein the complementary means of the nozzle includes the extra axial thickness of the tab.

3. The stage according to claim 1, wherein the axial dimension of the radially inner wall of the C-shaped member of each ring sector is greater than an axial dimension of a radially outer wall of the C-shaped member of each ring sector.

4. The stage according to claim 1, wherein facing lateral edges of annular tab sectors of the nozzle sectors include rectilinear slots for receiving sealing strips that extend radially outwards towards at least one of the casing rail and the split ring, the rectilinear slots extending in a plane situated upstream from the first recess and the second recess, or extending at least in part in the side webs of the nozzle sectors.

5. The stage according to claim 1, wherein the upstream end portion of the radially inner wall of the C-shaped member of each ring sector is spaced apart from a radial wall of the first recess of the nozzle by an axial clearance, and from an outer cylindrical wall of the first recess by a radial clearance.

6. A turbine engine comprising at least one turbine stage according to claim 1.

7. The stage according to claim 1, wherein the at least one notch of the upstream circumferential edge of the radially inner wall of the C-shaped member of each ring sector defines a first upstream end portion of the radially inner wall of the C-shaped member of each ring sector and a second upstream end portion of the radially inner wall of the C-shaped member of each ring sector, and the first upstream end portion of the radially inner wall of the C-shaped member of each ring sector is engaged inside and enclosed by the first recess, and the second upstream end portion of the radially inner wall of the C-shaped member of each ring sector is engaged and enclosed by the second recess.

8. The stage according to claim 1, wherein the first recess extends over more than half of a circumferential dimension of the nozzle.

* * * * *